US008544706B2

(12) United States Patent
Crye

(10) Patent No.: US 8,544,706 B2
(45) Date of Patent: Oct. 1, 2013

(54) HANDGUN HOLSTER

(75) Inventor: Caleb Clark Crye, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 468 days.

(21) Appl. No.: 12/688,780

(22) Filed: Jan. 15, 2010

(65) Prior Publication Data

US 2011/0174847 A1 Jul. 21, 2011

(51) Int. Cl.
*F41C 33/02* (2006.01)

(52) U.S. Cl.
USPC ..... 224/198; 224/193; 224/197; 224/243; 224/244

(58) Field of Classification Search
USPC ..... 224/192, 193, 198, 238, 239, 243–246, 224/911, 912, 914, 931, 197, 199, 200, 672; D3/222
See application file for complete search history.

(56) References Cited

U.S. PATENT DOCUMENTS

| | | | | |
|---|---|---|---|---|
| 4,955,518 | A * | 9/1990 | Parsons et al. | 224/247 |
| 5,215,238 | A | 6/1993 | Baruch | |
| 6,112,962 | A | 9/2000 | Matthews | |
| 6,264,079 | B1 | 7/2001 | Skaggs | |
| 6,267,279 | B1 | 7/2001 | Matthews | |
| 6,702,165 | B1 * | 3/2004 | Ramirez | 224/199 |
| 7,380,692 | B2 * | 6/2008 | Kostal et al. | 224/666 |
| 8,079,503 | B1 * | 12/2011 | Yeates et al. | 224/666 |
| 2006/0022007 | A1 * | 2/2006 | Hughes et al. | 224/671 |
| 2007/0289045 | A1 * | 12/2007 | Evans et al. | 2/102 |
| 2008/0121670 | A1 | 5/2008 | Buress | |
| 2008/0272162 | A1 | 11/2008 | Gamble | |
| 2009/0001117 | A1 | 1/2009 | Rassias | |

OTHER PUBLICATIONS

Forbus Tactical Holster, http://www.fobusholster.com/catalog/Tactical_Holsters-56-1.html downloaded Apr. 28, 2010.
Blade-Tech Industries AR 15/ M16 Pouches http://www.blade-tech.com/Injection-Molded-AR-15-M16-Pouches-pr-974.html#product_images & http://216.71.158.68/webcat/smalltek.shtml downloaded Apr. 28, 2010.
G-CODE™ MOLLE Claw™ http://www.eagleindustries.com/product.php?productid=596&js=y downloaded Apr. 28, 2010.
The G-CODE™ RTI™ MOLLE Claw™ http://www.eagleindustries.com/product.php?productid=16210&cat=93&page=1 downloaded Apr. 28, 2010.
New Safariland 6004 Accessory" http://soldiersystems.net/2008/05/31/new-safariland-6004-variant/ downloaded Apr. 28, 2010.
BLACKHAWK! SERPA Platform A http://www.blackhawk.com/product/SERPA-Platform-Ambidextrous,772,82.htm downloaded Apr. 28, 2010.
SERPA Quick Disconnect Kit http://www.blackhawk.com/product/SERPA-Quick-Disconnect-Kit-2-Female1-Male,1239,1441.htm downloaded 201-04-28.

* cited by examiner

*Primary Examiner* — Nathan J Newhouse
*Assistant Examiner* — Adam Waggenspack
(74) *Attorney, Agent, or Firm* — Stiennon & Stiennon

(57) ABSTRACT

A handgun holster permits sideward extraction of the weapon, and engages with the central portions of the handgun without regard to accessories mounted to the front or beneath the barrel. The holster has a main element which engages the central region of the pistol in a snap fit between two opposed arms. Lateral projections extend from the back wall to restrict the side-to-side displacement of the gun and two resilient flaps extend around the engaged gun, providing additional retention, and covering the on/off switch of any flashlight accessory. The main element is connected to a mounting assembly to permit the main element to be set at any desired angular orientation with respect to the mounting assembly. The mounting assembly has two expandable parts with opposed flanges which permit mounting to either a conventional belt, or to a series of webbing pockets, such as in the military's PALS webbing attachment system.

19 Claims, 4 Drawing Sheets

HANDGUN HOLSTER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for mounting a handgun to a user for ready access.

The handgun is a weapon conventionally employed by public safety officers and military personnel in the line of duty. It is also carried by civilians for purposes of self-defense. In order to be readily available to project force when needed, the handgun must be supported on the user in a convenient and accessible fashion. A wide range of belt-mounted handgun holsters are known, as well as holsters supported by other rigs to facilitate concealed carry. A typical handgun holster may have a cup-like receptacle for the weapon. Such a holster requires the handgun to be withdrawn upwardly, requiring that the region above the holster be kept clear of other equipment or accessories. Moreover, vertical draw can be hampered by enclosed situations, and may increase the time required to bring the firearm into action.

Handguns may be provided with optional accessories such as flashlights, laser sights, and suppressors, which attach beneath or forward of the gun's barrel. In many cases, specialized holsters are required to accommodate the handgun with an attached accessory.

What is needed is a handgun holster that can readily accommodate firearms with or without accessories, and which permits convenient extraction of the weapon without requiring a vertical draw.

SUMMARY OF THE INVENTION

The handgun holster of the present invention permits sideward extraction of the weapon, and engages with the central portions of the handgun without regard to accessories mounted to the front or beneath the barrel. The holster has a nylon main element which engages the central region of the pistol in a snap fit between two opposed arms which project from the back wall of the main element and which are terminated by detents. Two lateral projections extend from the back wall to restrict the side-to-side displacement of the gun within the holster. Two resilient flaps extend from the main element and are connected to each other to extend around the engaged gun, providing additional retention, and covering the on/off switch of any flashlight accessory mounted to the gun. The main element is connected with an array of sector-shaped projections to a similar structure on a mounting assembly, to permit the main element to be set at any desired angular orientation with respect to the mounting assembly. The mounting assembly has two expandable parts with opposed flanges which permit mounting to either a conventional belt, or to a series of webbing pockets, such as in the military's PALS webbing attachment system.

It is a feature of the present invention to provide a pistol holster which allows a user to access the gun without having to draw the gun upward.

It is another feature of the present invention to provide a pistol holster which accommodates handguns with or without front mounted accessories such as flashlights and suppressors.

It is a further feature of the present invention to provide a pistol holster which provides a cover when not in use for the switch on a light mounted to the pistol, to restrict inadvertent activation of the light.

It is an additional feature of the present invention to provide a pistol holster which can attach to either a belt or PALS webbing.

It is yet another feature of the present invention to provide a pistol holster which allows the pistol to be mounted at a desired rotational position.

It is also a feature of the present invention to provide a pistol holster in which the rotation may be set by adjustment of only a single bolt.

Further objects, features and advantages of the invention will be apparent from the following detailed description when taken in conjunction with the accompanying drawings.

DESCRIPTION OF THE PREFERRED EMBODIMENTS

Referring more particularly to FIGS. 1-7, wherein like numbers refer to similar parts, a holster 20 for a pistol 22 is shown in FIGS. 1-4, and 6. The holster 20 is comprised of a retention assembly 24 which engages the pistol in a snap fit, and a mounting assembly 26 which is connected to the retention assembly at a selected orientation and which permits the holster to be mounted to a belt or a PALS webbing array.

Figure 1:
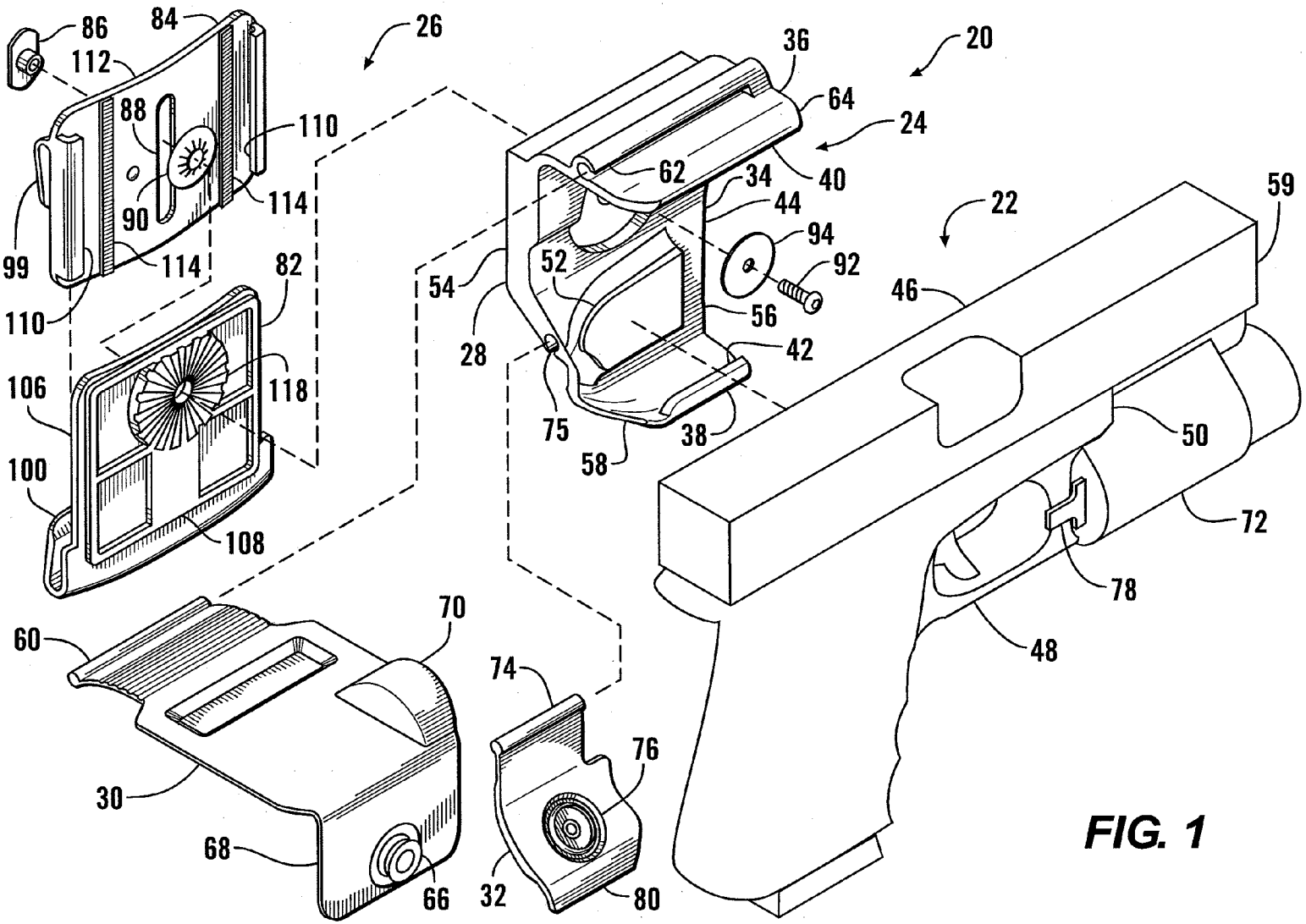
FIG. 1 is an exploded isometric view of the handgun holster of this invention.
Figure 6:
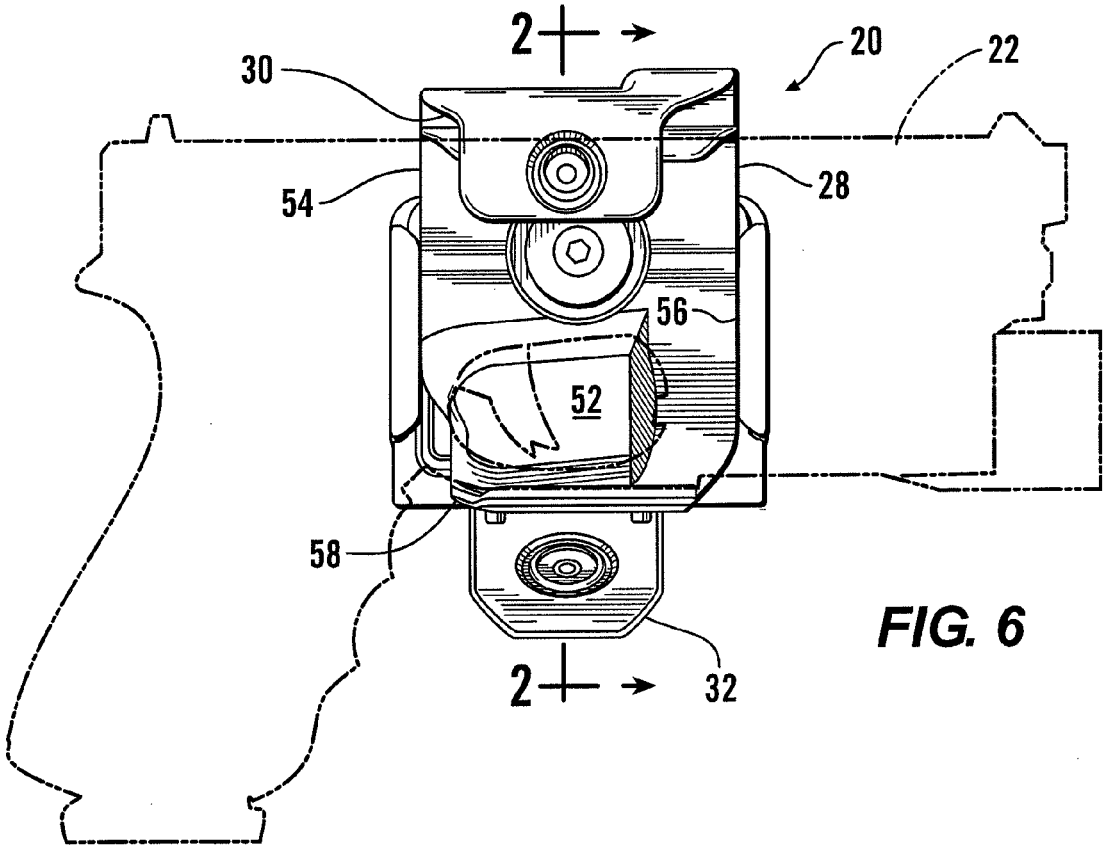
FIG. 6 is a front elevational view of the holster of FIG. 1 in an open configuration, partially broken away, with the engaged handgun shown in phantom view.

The retention assembly is comprised of a plastic main element 28, best shown in FIGS. 1 and 6, to which a resilient main flap 30 and secondary flap 32 are mounted. The main element 28 is preferably formed of nylon, which is desirably resilient and lubricious, and which resists compression set and is less likely to be worn away by repetitive insertion and removal of the firearm. The main element is formed to be as stiff as possible without requiring an unacceptable amount of force to remove the gun. The stiffer the part, the more effectively it retains the gun.

Figure 2:
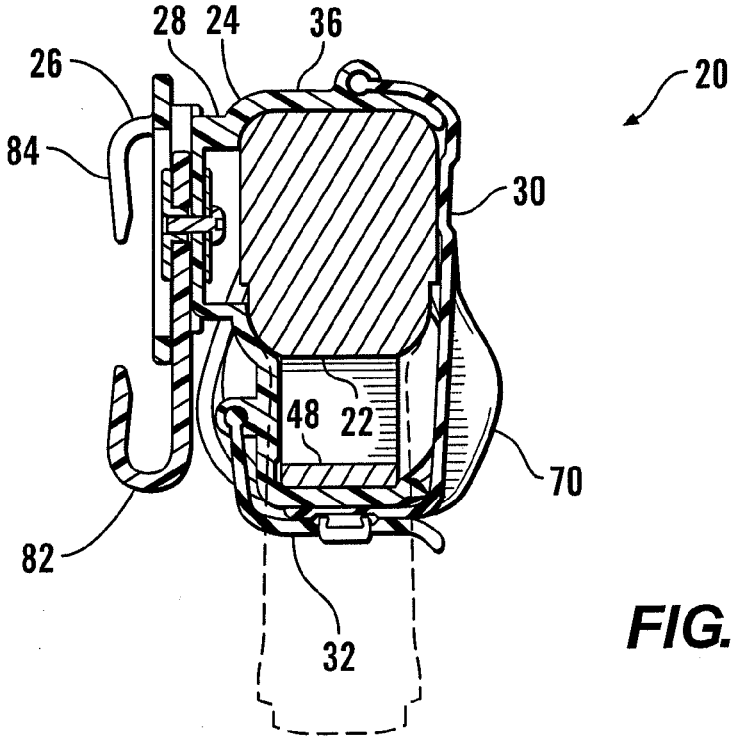
FIG. 2 is a cross-sectional view of the holster of FIG. 6, taken along section line 2-2, in a closed configuration.

The main element 28 is designed to accommodate a particular firearm, with engaging structure particularly suited to the dimensions and configuration of that weapon. As shown in FIG. 1, the main element 28 has a back wall 34 which extends vertically. A first arm 36 extends frontwardly from the back wall 34, and a second arm 38 extends frontwardly from the back wall at a location spaced below the first arm. The first arm 36 is terminated by a first detent 40 and the second arm is terminated by a second detent 42. The detents 40,42 extend towards each other across a gap 44, as shown in FIG.2. The first arm 36 and the second arm 38 are deflectable to engage in a snap fit with the handgun, which can be passed through the gap 44. The first arm first detent 40 engages at the top of the pistol along the upper corner of the slide 46, while the second arm second detent 42 engages beneath the trigger guard 48 of the pistol 22. This engagement holds the pistol 22 to the main element 28 of the holster 20, and restricts the up and down displacement of the weapon.

As shown in FIGS. 1 and 6, the engaged pistol is restrained from side-to-side displacement by structures which protrude outwardly from the main element 28. Although these structures might engage various parts of the firearm, in the illustrated embodiment, it is the pistol trigger guard 48 which is engaged. Because the trigger guard 48 rigidly extends from the pistol frame 50, by limiting movement of the trigger guard, the entire pistol's position is restrained. As shown in FIG. 6, the main element has a first side 54 on the left, and an opposite second side 56 on the right. A first lateral projection 52 extends outwardly from the main element 28 at a location spaced between the first arm and the second arm, and positioned between the first side and the second side. The first lateral projection 52 is generally in the shape of a truncated oval, and is configured to conform to the shape of the rear portions of the opening of the trigger guard 48. The second lateral projection 58 extends outwardly from the main element 28 at a location spaced laterally from the first lateral projection so as to engage portions of the inserted firearm's trigger guard 48 between the first lateral projection and the second lateral projection. The second lateral projection 58 takes the form of an upwardly extending lip extending from the first side 54 of the main element alongside the second arm 38. As shown in FIG. 6, the narrow, lower left portion of the pistol trigger guard 48 is engaged between the first lateral projection 52 and the second lateral projection 58, thereby restraining the side-to-side displacement of the pistol from the holster.

It should be noted that the second lateral projection 58, being mounted on the somewhat flexible second arm 38, is subject to deflection if sufficient force is applied. Thus the holster displays the desirable property of holding the pistol securely in ordinary use, but permitting the pistol to be withdrawn rearwardly if needed.

The second side 56 of the main element is clear of lateral projections, thus providing no interference to additional accessories that might be attached to the pistol beneath the gun barrel 59.

A supplementary restraint for the pistol 22 is provided by the flaps 30, 32, as shown in FIG. 2. The flaps 30, 32 are preferably formed of a high durometer TPR (thermoplastic rubber) such as Santoprene® material manufactured by Exxon Mobil Corporation. The flaps 30, 32, although sufficiently stiff to lock the gun clip closed, are still flexible enough to withstand the large deflection required to bring them from the full open position to a full closed and snapped shut position. As shown in FIG. 1, the main flap 30 has a protuberant upper bead 60 which is received within a frontwardly facing channel 62 which extends adjacent the upper portion of the first arm 36. The channel 62 allows the bead to be inserted from one side, and is closed at the opposite end.

The main flap 30 extends along an upper ramp 64 formed in the first arm 36, and passes over the first detent 40 and downwards to overlie the second arm 38 in a closed position, as shown in FIG. 2. A first part of a two-part fastener, such as the stud 66 of an easy action snap fastener, is attached to the free end 68 of the main flap 30. The main flap 30 may be formed with a semicylindrical bulge 70, as best shown in FIG. 1, to effectively cover portions of a protruding flashlight accessory 72 mounted beneath the barrel 59 of the pistol 22, such as the Surefire X400™ flashlight manufactured by SureFire, LLC of Fountain Valley, Calif. The main element 28 is formed with a corresponding recess 73 opposite the bulge 70 to provide clearance for the flashlight.

Figure 4:
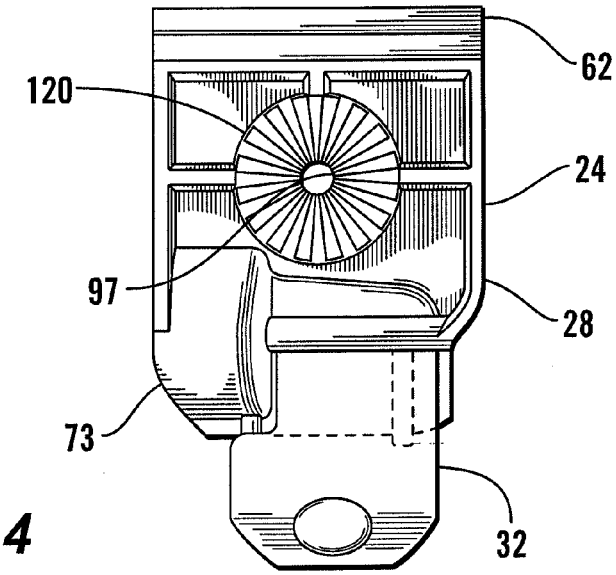
FIG. 4 is a rear elevational view of the main element of the holster of FIG. 1.

The secondary flap 32 has a bead 74 which is received within a channel 75 formed in the back wall 34 of the main element 28, as shown in FIG. 4. The secondary flap 32 hangs down from the main element, but extends over the second arm 38. The secondary flap may have the second part of a two part fastener, such as the socket 76 of a snap fastener. The main flap 30 can thus be engaged with and snapped in place with the secondary flap 32 to releasably fasten the first resilient flap to the second resilient flap in a closed configuration. The two-part fastener retains the first resilient flap fixed to the second resilient flap to restrict the movement of a gun engaged with the main element from movement away from the main element back wall. The connection of the flaps 30, 32 between the first arm 36 and the second arm 38 also helps to retain the pistol within the holster 20 by preventing the separation or spreading of the arms sufficiently to disengage the detents from the gun.

Figure 3:
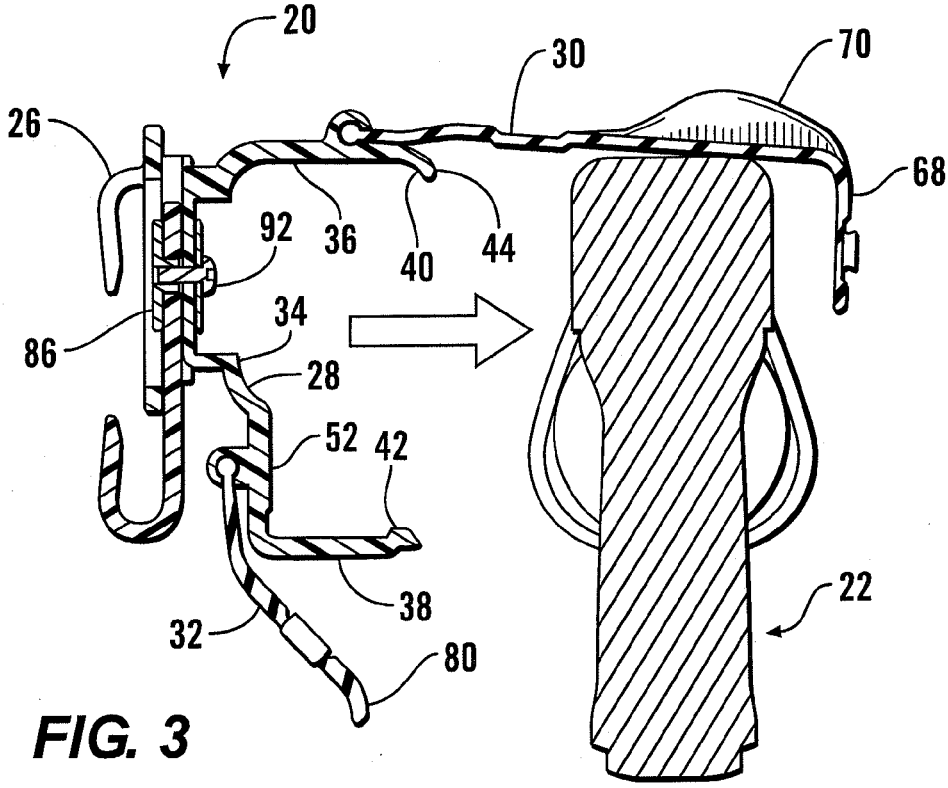
FIG. 3 is a cross-sectional view of the holster of FIG. 2, shown in an open configuration with the handgun exploded therefrom.

As best shown in FIG. 2, the secondary flap has a tab 80 which protrudes outwardly beyond the snap fastener, and which provides a convenient access to the secondary flap for separating the two-part fastener. The molded shape of the secondary flap is such that it will extend downwardly from the holster main element 28 when it is in an undistorted condition, as shown in FIG. 3. This molded-in shape gives the secondary flap 32 a natural "spring action" which allows it to clear the way for extracting the pistol when the snap fastener is released. The main flap 30 also has a molded-in shape, as shown in FIG. 1, which causes it to spring upwardly when the snap fastener is released.

As shown in FIG. 1, the accessory flashlight 72 may have a light switch 78 in proximity to the trigger guard 48. Thus the overlapping flaps 30, 32, not only help to retain the pistol in the holster, they also serve to prevent inadvertent access to the light switch 78 by the user or by contact with environmental objects. It is very desirable to avoid unintentionally turning on the light, both to avoid depleting the flashlight's battery, and to avoid calling attention to the user in a conflict situation.

Although a flashlight 72 is shown mounted to the pistol, other accessories such as a suppressor or a laser targeting device could also be mounted to the pistol and still accommodated in the holster 20.

The extraction of the pistol 22 from the holster 20 is illustrated in FIG. 3. The holster design permits a user to access the gun without having to draw the gun upward. An upward draw can sometimes be difficult under certain conditions such as seated in a vehicle. Furthermore, by extracting the weapon from the holster along a line which extends perpendicular to the back wall, 34, the user is not limited in what equipment can be carried directly above the handgun. To remove the pistol, the user flicks the protruding tab 80 with his index or middle finger, thereby releasing the two-part fastener and allowing the natural "spring action" molded into the flap to swing it out of the way. Then, gripping the pistol grip in the usual fashion, all that is required is a simple pull or rotation of the gripped pistol about a generally horizontal axis to flex the main element of the holster, freeing the pistol from the detents on the first and second arms, and allowing the pistol to be pulled free of the holster. To insert the handgun 22 into the retention assembly 24, the handgun is inserted into engagement with the detents. At least one of the detents is then deflected as the handgun 22 passes through the gap 44 into the main element 28. For example, the pistol may be set into place with the trigger guard engaged within the lower, second detent 42, and then pivoted about a horizontal axis to engage against and deflect the first detent 40 leading to the secure engagement of the pistol with the holster 20.

Figure 5:
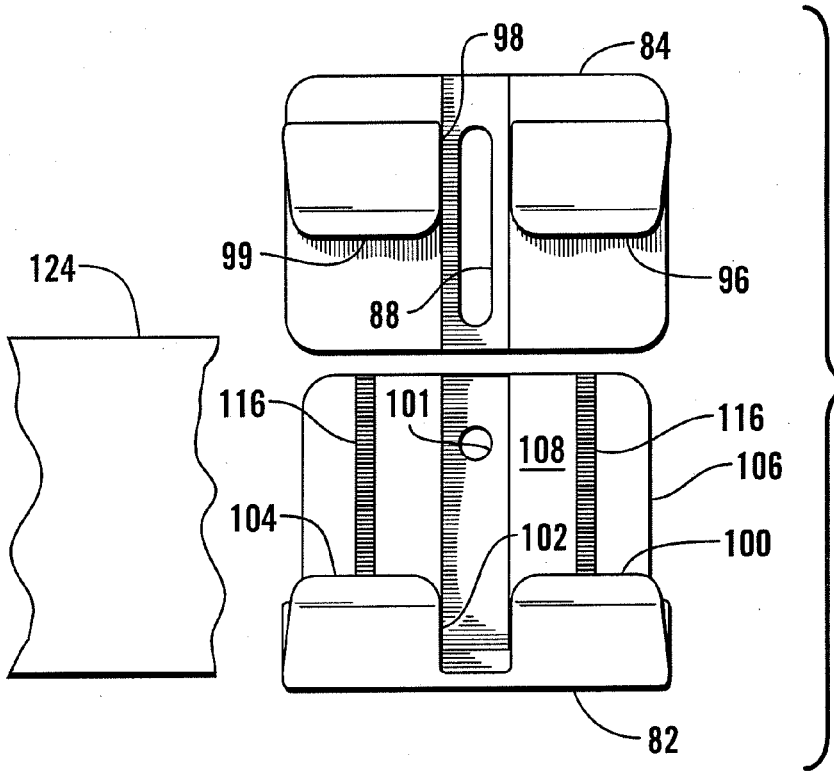
FIG. 5 is an exploded rear elevational view of the mounting assembly of the holster of FIG. 1.

The retention assembly 24 of the holster 20 is adjustably connected to the mounting assembly 26 for attachment of the holster to a belt or a PALS webbing array. As best shown in FIG. 1 and FIG. 5, the mounting assembly is comprised of an inner part 82 slidably connected to an outer part 84. A T-nut 86 is held in place to the outer part 84 within a vertical slot 88 by a self-locking external retaining ring 90, and is fastened to the main element 28 by a fastener 92 such as a socket button head screw with a washer 94. The mounting assembly inner part and outer part 82 are preferably molded in a glass filled nylon for increased stiffness.

As best shown in FIG. 5, the inner part 82 and outer part 84 of the mounting assembly 26 each are provided with two hook-like flanges which enable the holster to be connected to horizontal belts of various widths, or to a PALS webbing array. The outer part 84 has a first projecting flange 96 spaced across a flange gap 98 from a second projecting flange 99, both flanges pointing downwardly. The inner part likewise has a first projecting flange 100 spaced across a flange gap 102 from a second projecting flange 104. The inner part flanges 100, 104 extend upwardly towards the outer part flanges 96, 99.

As shown in FIG. 1, the inner part 82 has upwardly extending side rails 106 that project sidewardly from a body 108. The side rails 106 are received within upwardly extending guide channels 110 which project from a body 112 of the outer part 84. The mating of the rails 106 within the channels 110 allows the inner part 82 to engage with the outer part 84 in a telescoping relationship. The outer part 84 body 112 has two parallel protruding strips of serrations 114 which face and engage with two parallel recesses of similar serrations 116 on the inner part body 108, as shown in FIG. 5. The mating serrations allow the telescoping inner part and outer part to be positioned at any desired spacing of the flanges.

As shown in FIG. 1, the inner part body has portions defining an array 118 of frontwardly projecting generally sector-shaped projections. As shown in FIG. 4, the main element 28 back wall 34 has a rearwardly facing array 120 of rearwardly projecting generally sector-shaped projections which can mate with the inner part array 118 in a variety or orientations. The slot 88 extends upwardly through the mounting assembly outer part 84 body 112. The slot 88 is positioned between the outer part first flange and second flange. The T-nut 86 extends through the slot 88 and connects to the fastener 92, which passes through a hole 97 in the main element 28 and a hole 101 in the inner part 82 thereby connecting the mounting assembly to the holster main element in a selected rotatable orientation.

Figure 7:
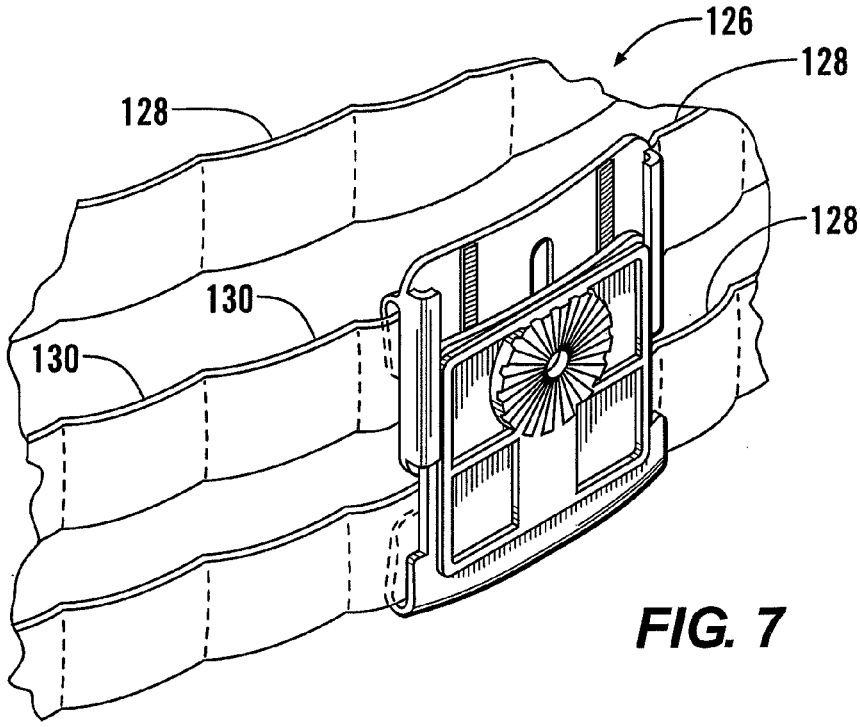
FIG. 7 is an isometric view of the mounting assembly of FIG. 5 connected to a conventional PALS (Pouch Attachment Ladder System) webbing of a modular pouch attachment system element of military protective gear.

As shown in FIG. 5, the mounting assembly may connect the holster 20 to a conventional belt 124, for example one encircling the waist of the user. By loosening the fastener 92 the inner part is made adjustable with respect to the outer part, and the user may choose the flange spacing to suit a particular belt. Moreover, the orientation of the retention assembly with respect to the mounting assembly may be adjusted. Once the spacing and orientation of the parts is as desired, the fastener 92 is secured and the parts are locked in place. To more comfortably conform to a user's waist, the portions of the mounting assembly which face the belt may be formed to be concave, with a curvature as shown in FIG. 7.

The mounting assembly, in addition to cooperating with a belt 124, may affix the holster 20 to a grid of straps, such as the Pouch Attachment Ladder System or PALS grid of webbing used to attach smaller equipment onto load bearing platforms, such as vests and backpacks, and those used in the MOLLE packs employed by the US military. As shown in FIG. 7, a conventional PALS grid 126 has horizontal rows 128 of one-inch webbing which are spaced one-inch apart. Each web is sewn to the backing at 1.5-inch intervals to define a sequence of loops 130 which are closed sidewardly, but are open upwardly and downwardly. The mounting assembly 26 can be adjusted to bring the outer part 84 flanges 96, 99, downwardly into two loops 130 of an upper row 128, with the gap 98 between the flanges 96, 99, coinciding with the seam between two loops. The inner part flanges 100, 104, extend upwardly into the loops on a lower row 128. Thus it will be observed that the same mounting assembly 26 can attach the holster 20 to a horizontally extending belt, or to loops which open vertically.

It is understood that the invention is not limited to the particular construction and arrangement of parts herein illustrated and described, but embraces all such modified forms thereof as come within the scope of the following claims.

I claim:

1. A holster for a handgun comprising:

a main element having an upwardly extending back wall, and having a first side and an opposite second side, wherein the main element has a first arm which projects from the back wall between the first side and the second side, and wherein the main element has a second arm which projects from the back wall between the first side and the second side, and is spaced opposite to the first arm, a gap being defined between the first arm and the second arm;

a first detent projecting from the first arm towards the second arm;

a second detent projecting from the second arm towards the first arm and spaced from the first detent, wherein at least one of the detents is deflectable to engage the handgun in a snap fit between the first arm and the second arm;

a first lateral projection extending outwardly from the main element at a location spaced between the first arm and the second arm, and positioned between the first side and the second side; and a second lateral projection connected to the main element and spaced laterally from the first lateral projection so as to engage portions of an inserted handgun between the first lateral projection and the second lateral projection, wherein the first lateral projection projects into a trigger guard of the handgun engaged in place between the first arm and the second arm, the trigger guard of the pistol being held in place with the second lateral projection, to thereby restrain the side-to-side displacement of the pistol with respect to the holster.

2. The holster of claim 1 further comprising:

a first resilient flap mounted to the main element and extending from the first arm towards the second arm to overlie an engaged handgun;

a fastener assembly to releasably fasten the first resilient flap with respect to the second arm to keep the first resilient flap in a closed configuration.

3. The holster of claim 2 further comprising a second resilient flap mounted to the main element and extending towards the first arm, wherein the fastener assembly connects the first resilient flap to the second resilient flap.

4. The holster of claim 3 wherein the fastener assembly comprises:

a first part mounted to the first resilient flap, and a second part mounted to the second resilient flap, the fastener first part and second part configured to cooperate to retain the first resilient flap fixed to the second resilient flap to restrict a gun engaged with the main element from movement away from the main element back wall.

5. The holster of claim 1 further comprising a mounting assembly comprised of:

a first part adjustably connected to a second part;

the first part having a first projecting flange spaced across a flange gap from a second projecting flange; and the second part having a first projecting flange spaced across a flange gap from a second projecting flange, the second part flanges extending towards the first part flanges, the first part and the second part having cooperating portions to allow the adjustment of the relative spacing between the first part flanges and the second part flanges.

6. The holster of claim 5 wherein the main element has an array of rearwardly projecting generally sector-shaped projections; and wherein the mounting assembly second part has an array of frontwardly projecting generally sector-shaped projections; and wherein the mounting assembly first part has a slot positioned between the first part first flange and second flange; the holster further comprising:

a fastener which extends through the slot and which connects the mounting assembly to the holster main element in a selected rotatable orientation in which the main element generally sector-shaped projections engage the mounting assembly second part generally sector-shaped projections.

7. The holster of claim 1, wherein the second lateral projection comprises an upwardly extending lip extending from the first side of the main element alongside the second arm, the second lateral projection being subject to deflection if sufficient force is applied, to permit the handgun to be withdrawn rearwardly to pass over the second lateral projection if required.

8. The holster of claim 1 wherein the second side of the main element is clear of lateral projections, thus providing no interference to accessories that might be attached to the handgun beneath the gun barrel.

9. A holster for a handgun comprising:

a main element having an upwardly extending back wall;

wherein the main element has a first arm which projects in a first direction from the back wall;

wherein the main element has a second arm which projects in the first direction from the back wall and is spaced in a second direction from the first arm, the second direction being perpendicular to the first direction;

a first detent projecting from the first arm towards the second arm;

a second detent projecting from the second arm towards the first arm, wherein at least one of the detents is deflectable to engage the handgun in a snap fit;

a first resilient flap mounted to the main element and extending from the first arm towards the second arm to overlie an engaged handgun;

a fastener assembly to releasably fasten the first resilient flap with respect to the second arm to keep the first resilient flap in a closed configuration; and portions of the main element project from the back wall in the first direction to engage a handgun and restrict its motion in a third direction which is perpendicular to the first and second directions, wherein the first arm has a width in the third direction and the second arm has a width in the third direction, and wherein the projecting portions of the main element include portions which are positioned intermediate between the widths of the first arm and the second arm, the main element being open to permit an engaged handgun having a width in the third direction which is greater than the first arm and second arm widths to project in the third direction beyond the main element on both sides.

10. The holster of claim 9 further comprising a second resilient flap mounted to the main element and extending towards the first arm, wherein the fastener assembly connects the first resilient flap to the second resilient flap.

11. The holster of claim 10 wherein the fastener assembly comprises:

a first part mounted to the first resilient flap, and a second part mounted to the second resilient flap, the fastener first part and second part configured to cooperate to retain the first resilient flap fixed to the second resilient flap to restrict a gun engaged with the main element from movement away from the main element back wall.

12. The holster of claim 9 further comprising a mounting assembly comprised of a first part adjustably connected to a second part;

the first part having a first projecting flange spaced across a flange gap from a second projecting flange; and the second part having a first projecting flange spaced across a flange gap from a second projecting flange, the second part flanges extending towards the first part flanges, the first part and the second part having cooperating portions to allow the adjustment of the relative spacing between the first part flanges and the second part flanges.

13. The holster of claim 12 wherein the main element has an array of rearwardly projecting generally sector-shaped projections, and wherein the mounting assembly second part has an array of frontwardly projecting generally sector-shaped projections, and wherein the mounting assembly first part has a slot positioned between the first part first flange and second flange; and the holster further comprises:

a fastener which extends through the slot and which connects the mounting assembly to the holster main element in a selected rotatable orientation in which the main element generally sector-shaped projections engage the mounting assembly second part generally sector-shaped projections.

14. A holster and load bearing platform assembly for a handgun comprising:

a load bearing platform having two rows of webbing sewn to a backing to define loops on each row which are closed sidewardly and open upwardly and downwardly;

a main element having an upwardly extending back wall, and having a first side and an opposite second side;

wherein the main element has a first arm which projects from the back wall between the first side and the second side;

wherein the main element has a second arm which projects from the back wall between the first side and the second side, and is spaced opposite to the first arm, a gap being defined between the first arm and the second arm;

portions extending from the first arm and the second arm, said portions being spaced apart from one another to engage in a snap fit with a handgun received between the first arm and the second arm;

a mounting assembly first part adjustably connected to a mounting assembly second part, the mounting assembly being connected to the main element;

the mounting assembly first part having a first projecting flange spaced across a flange gap from a second projecting flange; and the mounting assembly second part having a first projecting flange spaced across a flange gap from a second projecting flange, the second part flanges extending towards the first part flanges, the first part and the second part having cooperating portions to allow the adjustment of the relative spacing between the first part flanges and the second part flanges, wherein the mounting assembly first part first projecting flange and second projecting flange extend downwardly into the loops of one row, and the mounting assembly second part first projecting flange and second projecting flange extend upwardly into the loops of the other row, to thereby connect to the load bearing platform, wherein the main element is connected to the mounting assembly for rotatable adjustment therewith, and the mounting assembly first part and second part are connected to each other and to the main element by the same fastener, such that adjustment of said fastener secures the spacing of the first part flanges and the second part flanges, as well as the orientation of the mounting assembly with respect to the main element, the fastener being accessible by a user when the holster is mounted to the load bearing platform.

15. The assembly of claim 14 wherein the main element has an array of rearwardly projecting generally sector-shaped projections and wherein the mounting assembly second part has an array of frontwardly projecting generally sector-shaped projections, and wherein the mounting assembly first part has a slot positioned between the first part first flange and second flange, wherein the fastener extends through the slot and connects the mounting assembly to the holster main element in a selected rotatable orientation in which the main element generally sector-shaped projections engage the mounting assembly second part generally sector-shaped projections.

16. The assembly of claim 14 further comprising:

a first resilient flap mounted to the main element and extending from the first arm towards the second arm to overlie an engaged handgun;

a fastener assembly to releasably fasten the first resilient flap with respect to the second arm to keep the first resilient flap in a closed configuration.

17. The assembly of claim 16 further comprising a second resilient flap mounted to the main element and extending towards the first arm, wherein the fastener assembly connects the first resilient flap to the second resilient flap.

18. The assembly of claim 17 wherein the fastener assembly comprises:

a first part mounted to the first resilient flap, and a second part mounted to the second resilient flap, the fastener first part and second part configured to cooperate to retain the first resilient flap fixed to the second resilient flap to restrict a gun engaged with the main element from movement away from the main element back wall.

19. A holster for a handgun comprising:

a main element having an upwardly extending back wall, and having a first side and an opposite second side, wherein the main element has a first arm which projects from the back wall between the first side and the second side, and wherein the main element has a second arm which projects from the back wall between the first side and the second side, and is spaced opposite to the first arm, a gap being defined between the first arm and the second arm;

a first detent projecting from the first arm towards the second arm;

a second detent projecting from the second arm towards the first arm and spaced from the first detent, wherein at least one of the detents is deflectable to engage the handgun in a snap fit between the first arm and the second arm;

a first lateral projection extending outwardly from the main element at a location spaced between the first arm and the second arm, and positioned between the first side and the second side; and a second lateral projection extending outwardly from the main element at a position spaced laterally from the first lateral projection so as to engage portions of an inserted handgun between the first lateral projection and the second lateral projection, the second lateral projection comprising an upwardly extending lip extending from the first side of the main element alongside the second arm, wherein the first lateral projection projects into a trigger guard of the handgun engaged in place between the first arm and the second arm, the trigger guard of the pistol being held in place with the second lateral projection, to thereby restrain the side-to-side displacement of the pistol with respect to the holder.

* * * * *